United States Patent [19]

Allen

[11] 4,406,429

[45] Sep. 27, 1983

[54] MISSILE DETECTING AND TRACKING UNIT

[75] Inventor: John B. Allen, Richardson, Tex.

[73] Assignee: Texas Instruments Incorporated, Dallas, Tex.

[21] Appl. No.: 896,087

[22] Filed: Apr. 13, 1978

[51] Int. Cl.[3] ..... F41G 7/20

[52] U.S. Cl. ..... 244/3.11

[58] Field of Search ..... 244/3.11, 3.12

[56] References Cited

U.S. PATENT DOCUMENTS

| | | | |
|---|---|---|---|
| 2,930,894 | 3/1960 | Bozeman | 244/3.11 |
| 3,233,847 | 2/1966 | Girsberger | 244/3.12 |
| 3,366,346 | 1/1968 | McKnight et al. | 244/3.11 |
| 3,711,046 | 1/1973 | Barhydt et al. | 244/3.12 |
| 3,742,238 | 6/1973 | Hoffman | 250/347 |

*Primary Examiner*—Charles T. Jordan

*Attorney, Agent, or Firm*—Alva H. Bandy; N. Rhys Merrett; Melvin Sharp

[57] ABSTRACT

A system for detecting, tracking and guiding a missile to a target is disclosed. The missile has a beacon which emits infrared signals. A night sight, which has a reticled infrared receiver for sighting a target, detects the infrared signals of the missile relative to the center of the reticle and converts the infrared signals to electrical signals representative of the impinging infrared energy. The IR receiver output is connected to a computerized beacon tracking unit. The tracking unit determines when beacon signals are detected by the receiver, tracks and guides the missile to its destination by computing missile position pitch and yaw guidance signals to align the missile with the target.

11 Claims, 8 Drawing Figures

MISSILE DETECTING AND TRACKING UNIT

This invention relates to a receiver, tracker and guidance system, and more particularly, to a combined infrared sight and tracker unit for guiding a missile to a target.

In the past, carriers, such as guided missiles, have been guided with a system which consists of a beacon which is carried by the missile, a gunner's sight which includes a visual sight, an IR sight, a tracker unit, which includes an optical system, IR (0.9$\mu$) detector and signal processor, and a conductor wire. The light from the beacon which emits radiation in the vicinity of the electro-magnetic spectrum near 0.9 micron is imaged onto a detector in the tracker unit at the launcher and measurements are made on the signals from the detector to determine the missile's position relative to its destination or target. The target is located with the visual sight or with the IR sight at the gunner's option and tracked with the tracker unit. Corrections to the missile's trajectory are computed in the processing circuitry of the tracker unit and transmitted through the conductor wire to the missile. It has been found that the 0.9$\mu$ detector cannot sense the missile in the presence of fog, cloud coverage, smog, or smoke, if thick enough, and the tracking unit looses the missile. When this happens the missile can no longer be guided although the target can still be seen by the gunner. Also, the use of an IR sight along with a tracker unit unduly increases the size, weight, and cost of the system. Further, the missile guidance link can also be jammed by similar beacons attached to the target. That is, the tracking unit can mistake these beacons for the missile's beacon and hence give erroneous guidance information to the missile to the end that the missile does not reach the target.

Accordingly, it is an object of this invention to provide a combined infrared sight and tracker unit, system which can be utilized in conjunction with an infrared beacon on a carrier to allow carrier acquisition, tracking, and guidance in any atmospheric condition.

A further object of the invention is to provide an infrared sight and tracker unit having the capability of discriminating against optical jamming sources based on source location, intensity, and motion and track within the infrared sight field of view.

Another object of the invention is to provide an infrared sight and tracker unit having a decreasing carrier acquisition threshold after carrier acquisition to eliminate false energy sources consistent with maintaining carrier acquisition during flight to destination.

Still another object of the invention is to provide an infrared sight and tracker unit whose field of view, which is searched for continued carrier acquisition, is restricted to reduce substantially the amount of data for data processing.

Yet, another object of the invention is to provide an infrared sight and tracker unit which provides enhanced performance, and minimum size, weight, and cost.

Still yet another object of the invention is to substantially eliminate response to false missile information.

Briefly stated the combined infrared sight and tracker unit system constituting the present invention comprises an infrared sight means, which comprises a reticled forward looking infrared receiver for the dual use of sighting the target and tracking a missile, for example, to the target. The tracker unit includes a computer which is operative in conjunction with a vehicle (carrier or missile) and launcher and computes guidance information for the missile. The system is actuated when the missile is launched. The missile, preferably, carries an infrared emitting beacon which is activated upon firing; the light from the beacon, when the vehicle enters the field of view of the infrared sight means, enters as the brightest object in the field of view due to its close proximity to the sensor immediately after launch. The tracker unit initially searches the entire field of view of the infrared light means for the missile and after acquisition limits its search to a track box containing the expected missile position. The forward looking infrared receiver includes a scanner, a linear array of IR detector elements, and preamplifiers for amplifying the electrical outputs of the IR detector elements. Each detector element and preamplifier constitute a channel. The tracker unit consists of a scan counter which is reset at the beginning of each sight scan and counts the scanning time, a multiplexer connected to the electrical output of the infrared detector video channels, a comparator connected to the multiplexer output, and a processor connected to the comparator output. The comparator compares the multiplexer signals to a preselected threshold signal. When the threshold voltage of the comparator is exceeded by the energy received from the beacon or heated rocket motor of the missile if a beacon is not used, the processor reads the count residing in the scan counter and the multiplexer address which is the corresponding channel number. In addition the processor reads the value of the scan counter each time the sight scanner crosses boresight. At the end of each sight frame, the processor computes the angle off boresight in yaw by subtracting the boresight scan count coordinate from the vehicle scan count coordinate, and the angle off boresight in pitch by subtracting the number of the sight channel aligned with the sight reticle from the missile channel number coordinate. The processor then scales these values and converts to distance off boresight by multiplying by range to the missile. Range information is obtained by the processor from a preprogrammed range equation using time from first motion of the vehicle as the independent variable. The elapse in time is maintained in the processor by clearing a software counter on receipt of the first motion command and incrementing the counter on each sight frame. The scaled values of distance off boresight in yaw and pitch are outputed once each sight frame, latched, digital to analog (D/A) converted and fed to the control signal comparator. The processor after computing the vehicle position in the field of view for a given scan, then computes the location and size of a field of view (track box) which defines the range of scan counts and channel addresses which are to be searched for the missile on the next scan and outputs this information to the external electronics which uses it for multiplexer control.

The novel features characteristic of the embodiments of the invention may best be understood by reference to the following detailed description when used in conjunction with the accompanying drawings wherein.

Figure 2:
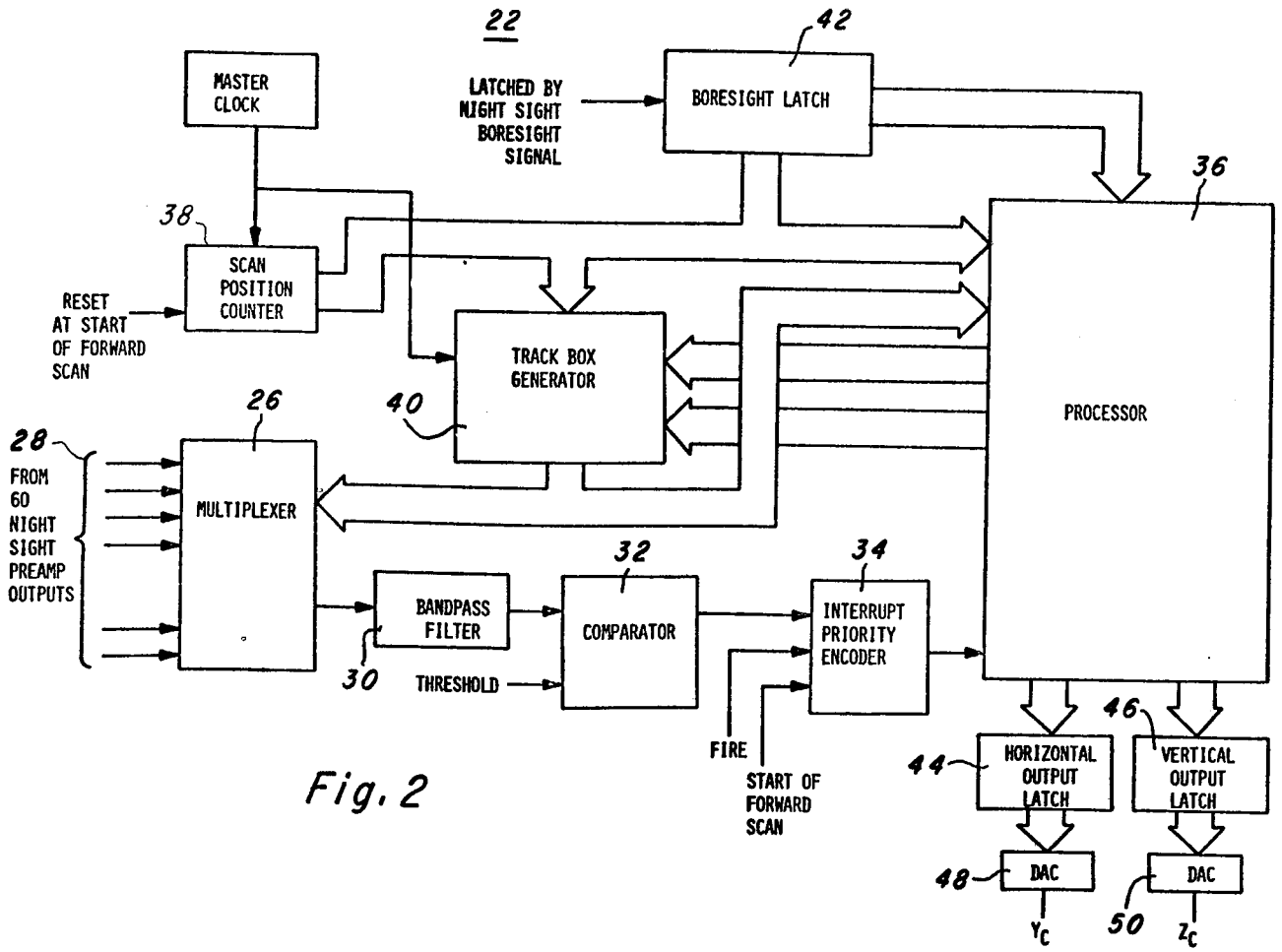
FIG. 2 is a block diagram of the infrared sight and tracker unit.
Figure 4A:
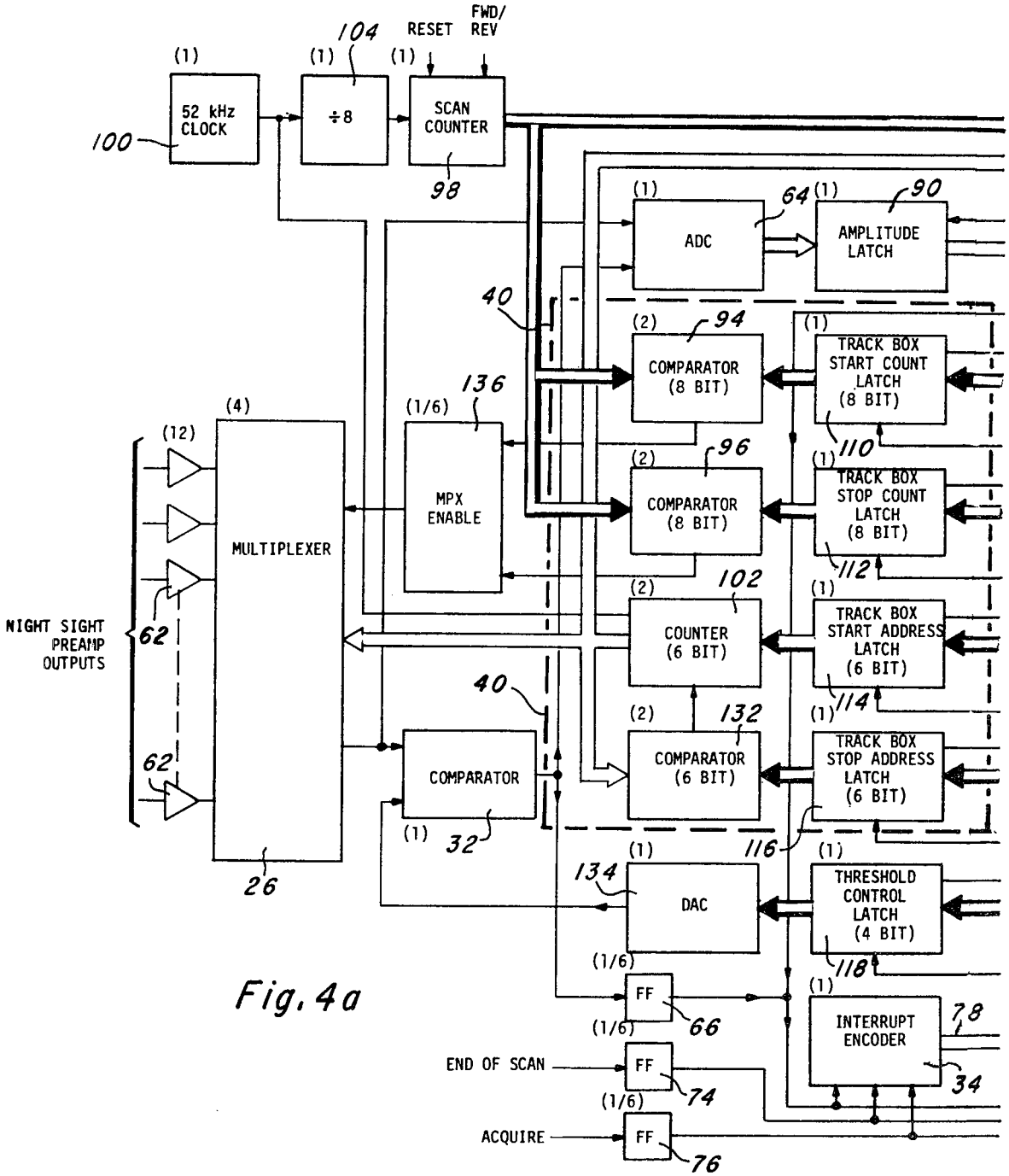
Figure 4B:
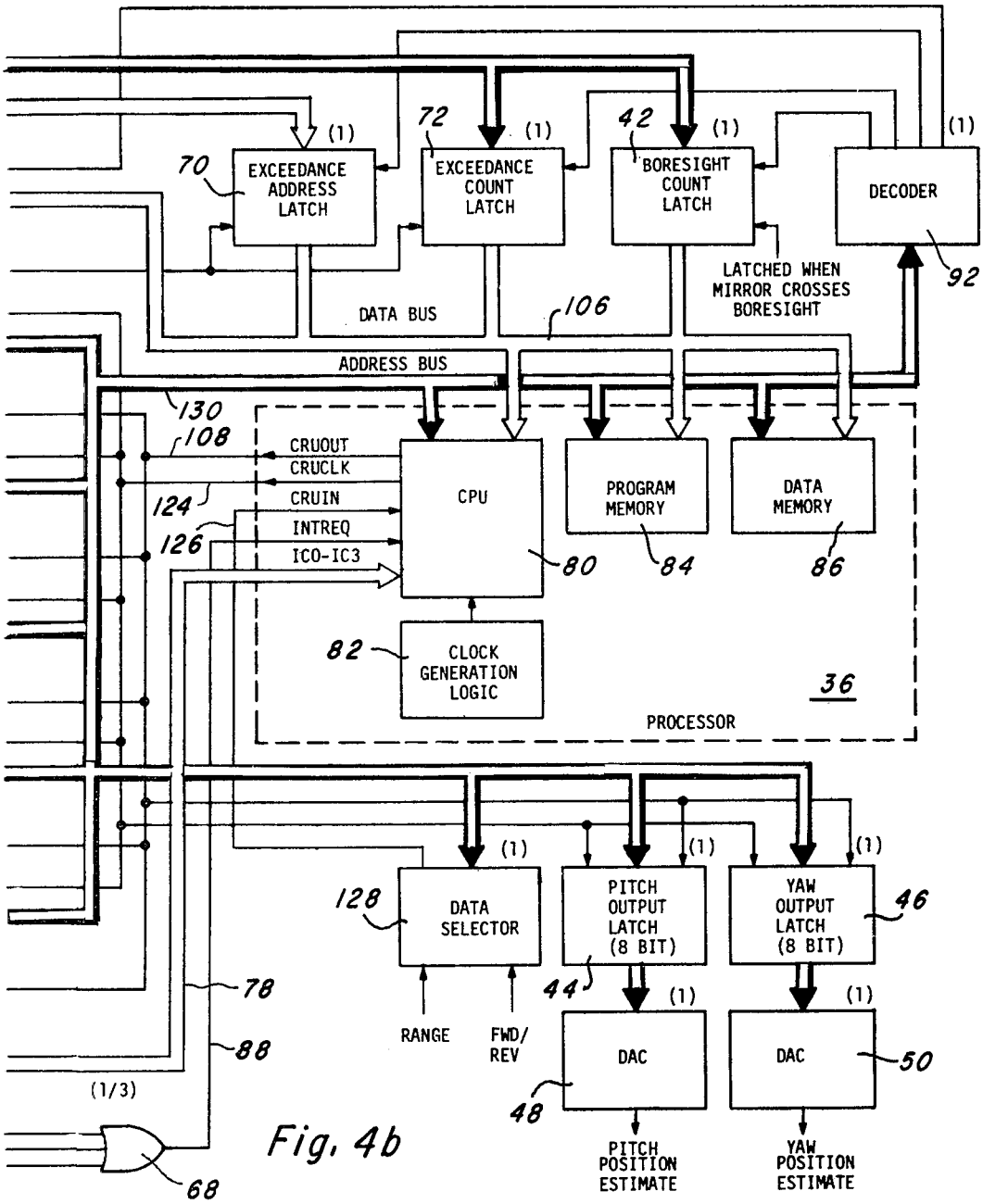
Figure 5:
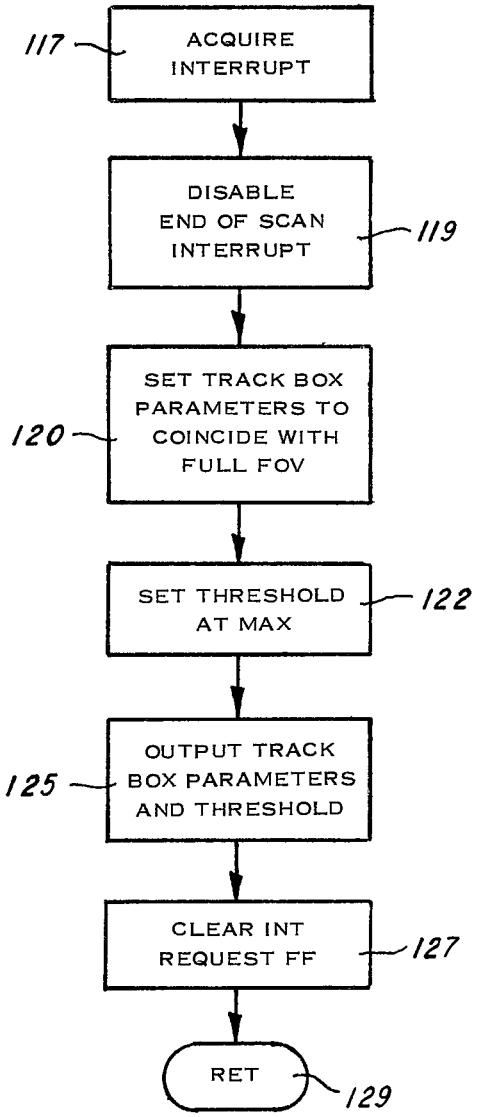
Figure 6:
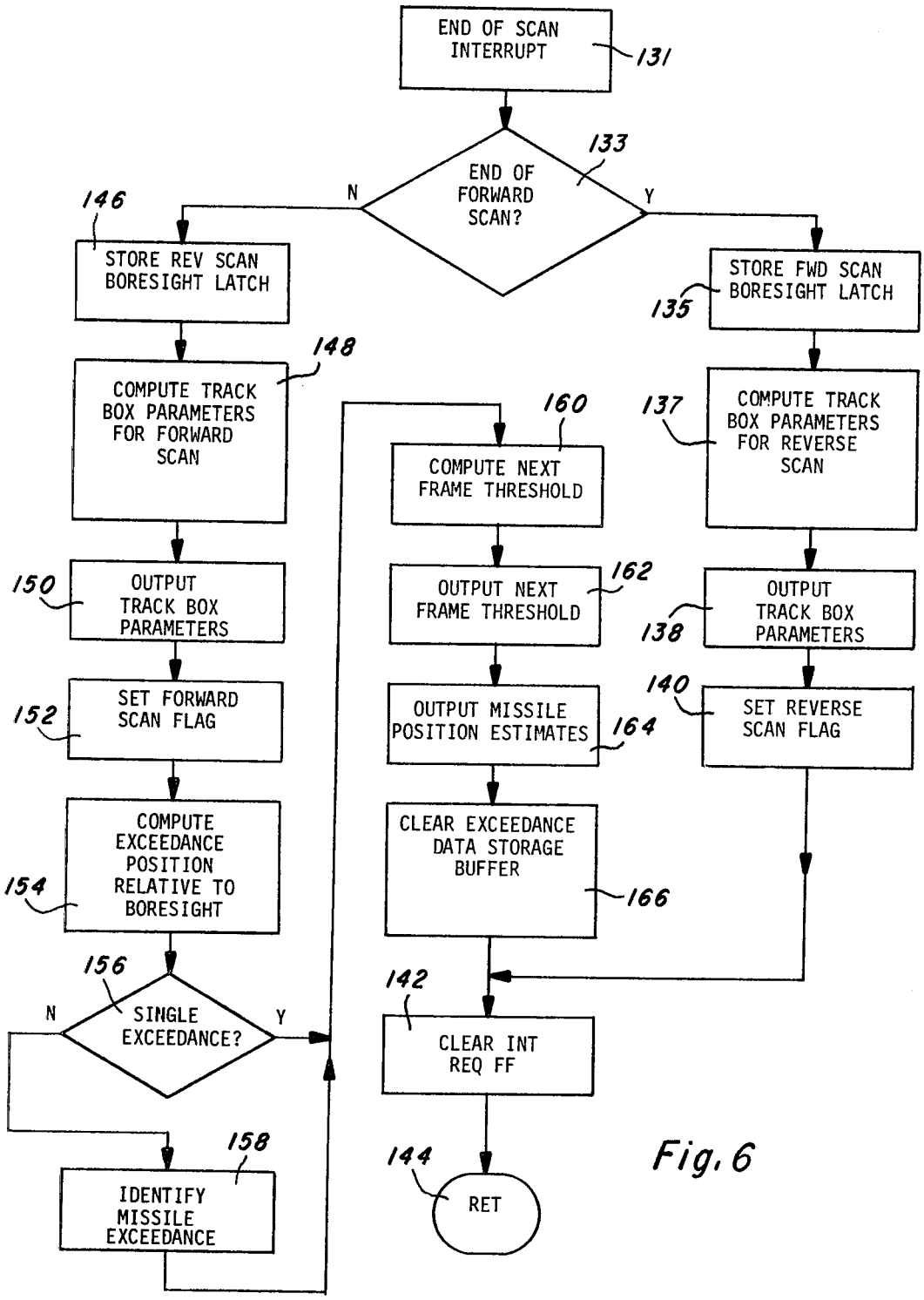
Figure 7:
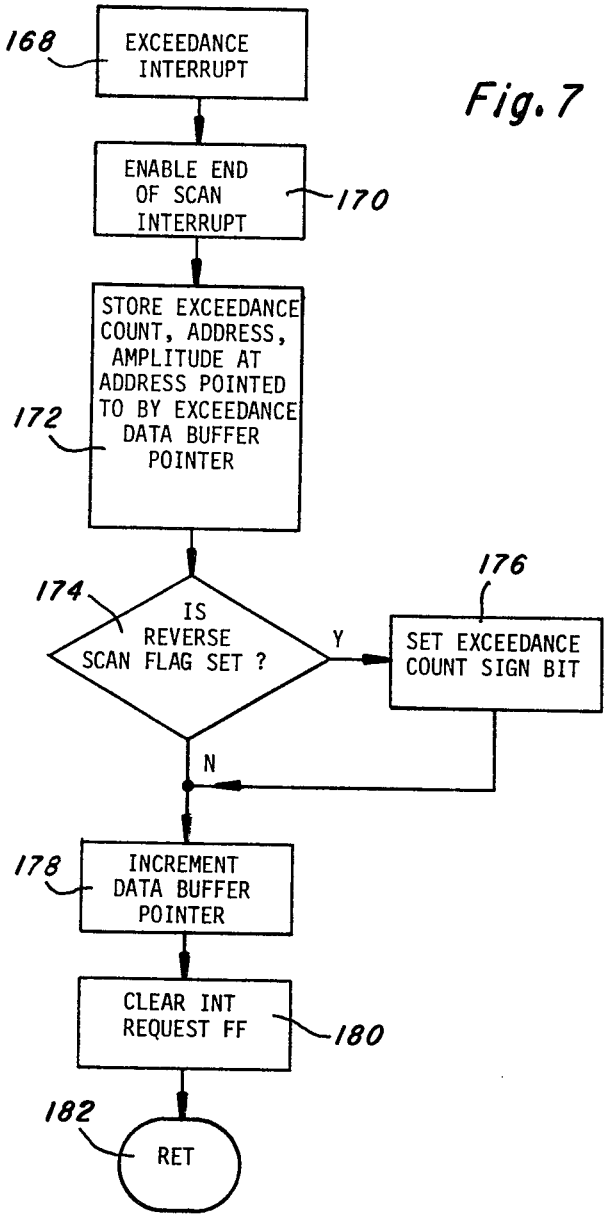

FIGS. 4*a* and 4*b* constitute a more detailed block diagram of the invention shown in FIG. 2;

FIG. 5 is a logic flow chart of the software used in the tracker unit for determining carrier acquisition;

FIG. 6 is a logic flow chart of the software used in the tracker unit for vehicle position computation;

FIG. 7 is a logic flow chart of the software used in the tracker unit for determining and storing exceedance data.

Figure 1:
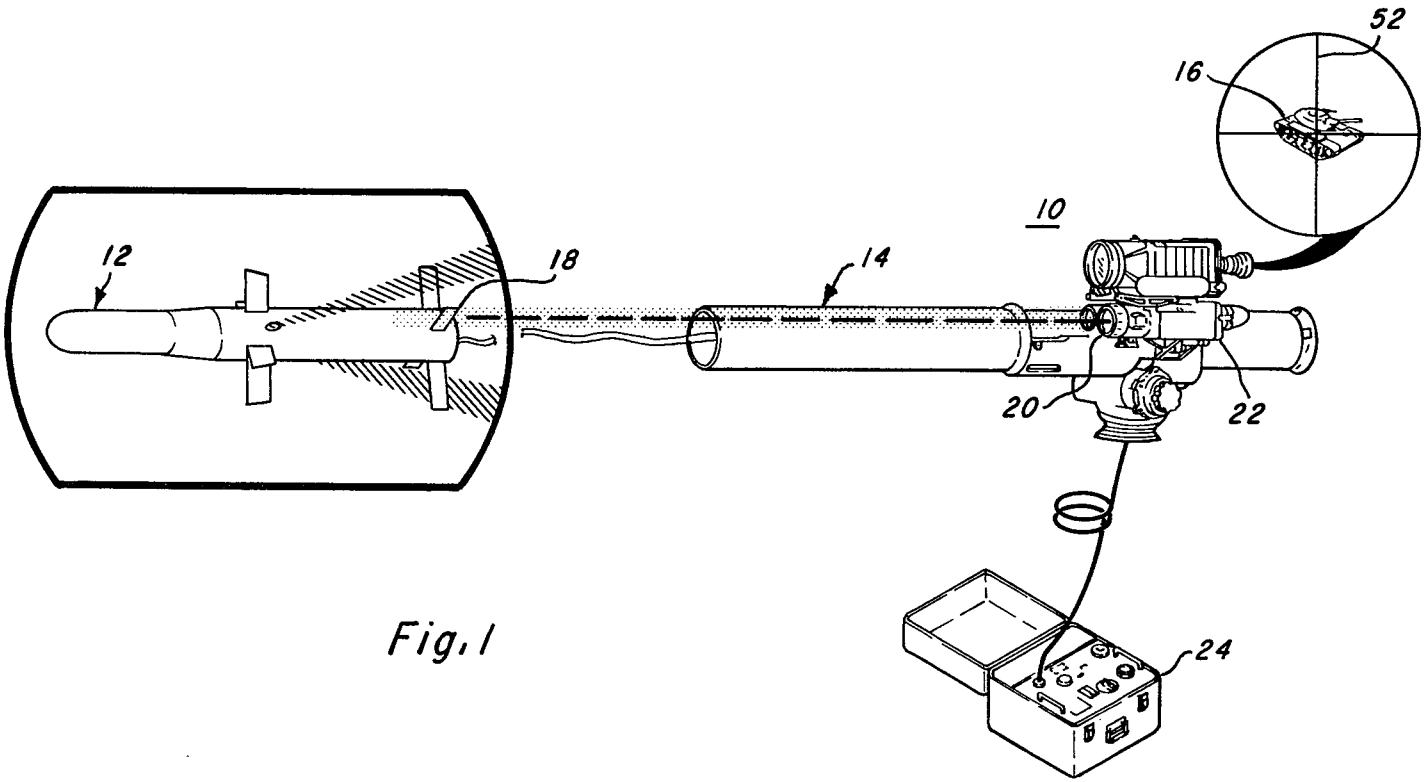
FIG. 1 depicts the utilization of the combined infrared sight and tracker unit.

Referring now to FIG. 1, the infrared sight and tracker unit system 10 comprises a carrier 12 which has been launched from launcher 14 toward its destination or target 16. The target 16 is shown as a tank viewed through the visual sight. It could also have been viewed through the infrared sight at the gunner's option. A beacon 18 is attached to the rear end of the carrier 12. A suitable beacon is, for example, a flare or a miniature $CO_2$ laser emitting electromagnetic energy (light) in the 8–14 micron region. A sighting means 20, which may be, for example, a thermal night sight, such as that manufactured by Texas Instruments Incorporated under the designation AN/TAS-5 Night Sight, is attached to the launcher 14 for viewing and tracking the carrier 12. The night sight is a forward looking infrared receiver and imaging device which includes a linear array of infrared detectors for scanning a field of view to detect the light emitted from the carrier's beacon. It will be appreciated by those skilled in the art that if the carrier is a missile powered by a motor, the heat from the motor might be used as the light source in lieu of the beacon. Each detector of the sighting means together with its preamplifer constitutes a channel (not shown) connected to the electronics package 22. Controller 24 controls the launching of the carrier, activation of its beacon, activation of the night sight infrared receiver and activation of the beacon tracker unit.

Referring now to FIG. 2, the beacon tracker unit of the electronic package 22 includes a multiplexer 26 connected to the night sight channels 28, a filter 30 connected to the multiplexer 26, a comparator 32 connected to the filter 30, an interrupt priority encoder 34 connected to the comparator 32, and a processor 36. The processor 36 (FIG. 2) is connected to the interrupt priority encoder 34 which also receives a first motion (FIRE) signal and a start of forward scan signal. A counter 38, which is reset at the start of each forward scan, is connected to a track box generator 40, a boresight latch 42, and the processor 36. The boresight latch 42, which is latched by a night sight boresight signal, has its output connected to the processor 36. The track box generator 40 receives track box definition signals from the processor 36 and provides track box defining signals to the multiplexer 26 and processor 36. Processor 36 also has outputs connected to a horizontal output latch 44 and vertical output latch 46. The horizontal output latch 44 and the vertical output latch 46 have their outputs connected, respectively, to digital to analog converters 48 and 50. The digital to analog converter 48 provides yaw correction signals and the digital to analog converter 50 provides pitch correction signals.

Figure 3:
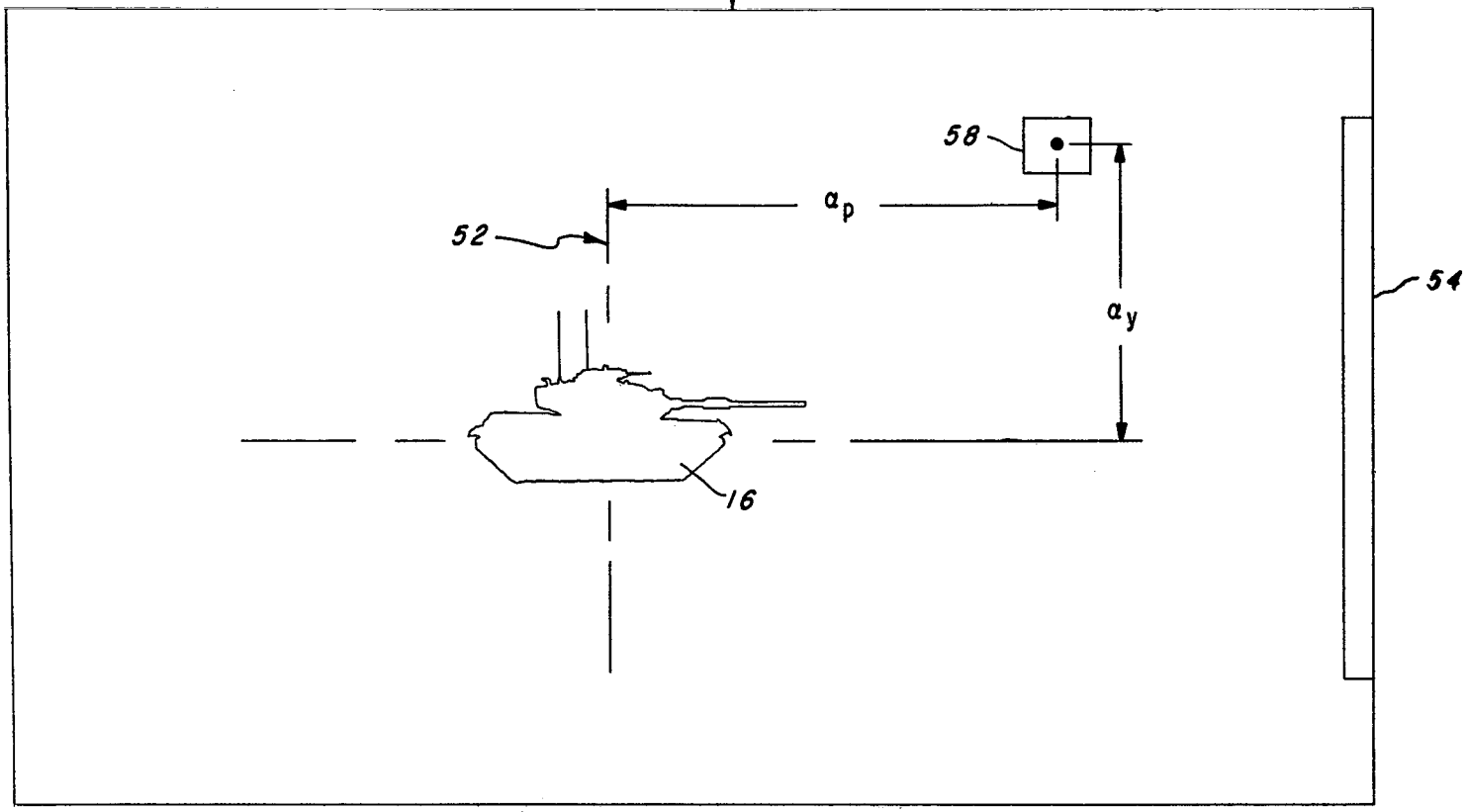
FIG. 3 depicts the concept of the invention.

Referring now to FIGS. 1 and 3, the sight 20 has it reticle 52 on target 16 when the carrier 12 is launched. Upon launch the beacon 18 (FIG. 1) of the carrier 12 and the counter 38 (FIG. 2) of the electronics package 22 are activated. Light from the beacon 18 first appears in the night sight's field of view as a bright source 54 (FIG. 3) along its right edge. Its bright light is detected by a detector of the night sight detector array, multiplexed in multiplexer 26 (FIG. 2), filtered in filter 30 and compared to a threshold voltage in comparator 32 to determine carrier acquisition. When a threshold voltage is exceeded, the processor 36 reads the count residing in the scan counter 38 as well as the multiplexer address (corresponding to the channel number). In addition, the processor 36 reads, in response to the signal of the boresight latch 42, the value of the scan counter 38 each time the night sight scanner crosses boresight. It will be appreciated that when the missile is initially acquired, it may encompass several resolution elements because it is so close to the sensor. Hence, several threshold exceedances may occur on adjacent resolution elements due to the missile. In this situation, the processor can compute the centroid of a cluster of adjacent exceedances, i.e.:

$$X = \frac{\sum_{i=1}^{N} X_i A_i}{\sum_{i=1}^{N} A_i}$$

$$Y = \frac{\sum_{i=1}^{N} Y_i A_i}{\sum_{i=1}^{N} A_i}$$

Where:

$X_i$=the azimuth coordinate of the i'th exceedance $Y_i$=the elevation coordinate of the i'th exceedance $A_i$=amplitude of i'th exceedance N=number of exceedance due to missile X=estimate of the azimuth coordinate Y=estimate of the elevation coordinate At the end of each night sight frame 56 (FIG. 3) the processor 36 (FIG. 2) computes the angle off boresight in yaw ($\alpha_y$, FIG. 3) by subtracting the boresight scan count coordinate from the missile scan count coordinate and the angle off boresight in pitch ($\alpha_p$) by subtracting the number of the night sight channel aligned with the reticle from the missile channel number coordinate. The processor then scales these values and converts to distance off boresight by multiplying by range to the missile; that is, $Z_c=(\alpha_p)$ (RANGE) and $y_c=(\alpha_y)$ (RANGE). The range is obtained by the processor from a preprogrammed range equation using time from first motion of the carrier as the independent variable. The time from first carrier motion is maintained in the processor 36 by clearing a software counter (not shown) on receipt of the first motion command and incrementing the count on each night sight frame. The scale values of distance off boresight in yaw and pitch are outputted by the processor 36 (FIG. 2) once each night sight frame, latched in horizontal and vertical output latches 44 and 46, digitized in their respective digital to analog converters 48 and 50, and fed to a comparator of the controller.

As the location of the missile within the night sight field of view is highly correlated from frame to frame, it is not necessary to search the entire field of view for the missile on each frame after initial acquisition. Instead, the processor 36, after computing the missile position in the field of view for a given range also computes the location and size of a track box 58 (FIG. 3) which defines the range of scan counts and addresses which are to be searched on the succeeding frame and outputs this information to the external electronics which uses it for multiplexer control. The track box 58 follows the carrier from acquisition and quickly collapses down to a size limited sufficiently to eliminate detection of sources within the scan frame but outside the track box. The track box must also be large enough to include the missile in its new position. The track box should be as small as possible to exclude sources of radiation which act as false beacons, but large enough to include the new position of the missile in the next frame.

It will be appreciated that alternative methods of missile acquisition exist. For example, as the launch geometry is fixed, it is reasonable to assume that the carrier will enter the night sight field of view at essentially the same place every time, but with some uncertainty due to sight centerline to carrier centerline orientation uncertainty and sight movement. Thus, the track box can be initially positioned at the expected location of entry into the field of view and sized large enough to accommodate the worst case uncertainty. In this method the acquisition proceeds in exactly the same manner as normal track.

In another method the carrier beacon will undoubtly enter as the brightest object in the field of view, thus, the entire field of view can be searched with a very high threshold by allowing the multiplexer to continuously cycle through all detector channels of the night sight. The high threshold will prevent other sources in the field of view from causing the threshold voltage to be exceeded. Accordingly, once a threshold occurs it is assumed that it arises from a carrier beacon. However, as the missile proceeds down course other threshold exceedances will occur due to countermeasure beacons or bright spots which have a lower amplitude than the missile exceedances. During initial acquisition, the highest amplitude exceedances are taken to be the missile exceedances and the lower amplitude exceedances are taken to be countermeasure exceedances. The location and amplitude of the false beacons are generally fixed in position relative to boresight if the target is stationary. As the intensity of the image of the missile's beacon decreases due to increasing distance from the sensor during the flight, the false beacons may be mistaken for the missile beacon. However, any beacon at the location of a known false beacon is taken to be a false beacon. Hence, the false beacon will not be confused with the missile beacon. If the missile beacon moves to the same location as a false beacon, the missiles position is taken to be the position of the false beacon which is located at the same point as the missile. When the missile moves away from the false beacon, the missile is reacquired and tracking continues. The missile is acquired again when a threshold exceedance occurs near the false beacon and has an amplitude sufficiently close to the predicted amplitude of the missile beacon.

If the target is moving, the boresight will also be moved by the operator to track the target. False beacons on the target will be fixed relative to boresight. False beacons in the background such as a fire will translate at the same angular velocity as the boresight moves. Hence, false beacons can be acquired and tracked so that they do not become confused with the missile.

Still another method utilizes the error signal from the control signal comparator to cue the night tracker as to the location of the missile. The optimum choice between these alternatives depend on many factors including desired modes of operation, severity and duration of night sight blanking due to launch blast, radio metric intensity of launch debris within the field of view, beacon intensity, and hardware complexity.

Refer now to FIGS. 4*a* and 4*b* for a more detailed description of the electronics system 22. The system 22 is used, for purposes of description only, in conjunction with the AN/TAS-5 Night Sight manufactured by Texas Instruments Incorporated. The sight has a 60 element infrared detector array and corresponding preamplifiers to provide 60 channels of video signals. Each of the video channels is connected to one of a corresponding plurality of amplifiers 62. Amplification of the video signals is necessary because of the low level of preamplification and the presence of fixed pattern noise in the multiplexer 26. In this tracking system the filter function of bandpass filter 30 (FIG. 2) is performed by the amplifiers 62. Each amplifier's bandpass is shaped to reject both the low frequency scene information which essentially amounts to clutter for the tracker and the high frequency noise. Each amplifier 62 may be, for example, a SNC25903J.

The amplifiers 62 (FIG. 4*a*) are connected to the multiplexer 26 where the signals are combined and fed to the comparator 32 and to an analog to digital converter 64. The comparator 32 may be, for example, a μA 711 comparator. The comparator examines the signals of the multiplexer for each scan to determine if any such signals exist which exceed the threshold voltage of the comparator. Comparator 32 is connected to a flip-flop 66 which may be, for example, an SNC 54174J, and to the analog to digital converter 64, which is, for example, an ADC 592-8. The output of flip-flop 66 is connected to the junction of an interrupt priority encoder 34 and OR gate 68 (FIG. 4*b*), and to the processor 36. The processor 36 addresses the decoder 92 which activates the exceedance address latch 70 and the exceedance count latch 72. The OR gate 68 and encoder 34 can be, respectively, a SNC 5410J and a SNC 54148J, and the exceedance latch 70 and exceedance count latch 72 are, for example, SNC 54100J latches.

The night sight 20 also provides an end of scan trigger signal and an "acquire" carrier signal for the tracker and guidance system. The end of scan signal is connected to a flip-flop 74 (FIG. 4*a*) and the "acquire" carrier signal is connected to a flip-flop 76. Flip-flops 74 and 76 are, for example, SNC54174J's. Flip-flop 74 is connected to the junction of the interrupt encoder 34 and OR gate 68 (FIG. 4*b*) to provide as an input to the processor 36 the end of scan signal, and flip-flop 76 (FIG. 4*a*) is connected to the junction of the interrupt encoder 34 and OR gate 68 (FIG. 4*b*) to provide as an input the "acquire" carrier signal. The interrupt encoder 34 (FIG. 4*a*) has its outputs connected through bus 78 to the central processing unit (CPU) 80 of the processor 36 (FIG. 4*b*). Processor 36 is, for example, a Texas Instruments Incorporated microprocessor SBP 9900, which in addition to the CPU 80 includes a clock 82 for the CPU, a program memory 84 and data memory 86. The OR gate 68 has its output connected by lead 88 to the interrupt request input (INTREQ) terminal of the processor's CPU 80.

The analog to digital converter 64 (FIG. 4*a*) is connected to an amplitude latch 90. The amplitude latch 90, exceedance address latch 70 (FIG. 4*b*), exceedance count latch 72, and boresight count latch 42 are connected to outputs of a decoder 92 for a purpose hereinafter described. Further, the exceedance count latch 72 and boresight count latch 42 as well as comparators 94 and 96 (FIG. 4*a*) of the track box generator 40 are connected to the output of a scan counter 98. The scan count is obtained from a clock 100, which is, for example, a 56 KHz clock. The clock is connected to the junction of a six-bit counter 102 of the tracker box generator 40 and a divide by eight circuit 104. The divide by eight circuit is, for example, a SNC54163J, connected to the scan counter 98. The scan counter 98 is, for example, a SNC54163J. The boresight latch 42 (FIG. 4*b*) is connected to the night sight 20 and is latched when the scanning mirror of the night sight crosses boresight. The amplitude latch 90 (FIG. 4*a*), exceedance address latch 70 (FIG. 4*b*), exceedance count latch 72, and boresight count latch 42 have their outputs connected through data bus 106 to the processor's CPU 80, program memory 84, and data memory 86.

The CPU 80 of the processor 36 has its communications register unit output (CRUOUT) terminal connected by lead 108 to the junction of a track box start count latch 110 (FIG. 4*a*), track box stop count latch 112, track box start address latch 114, track box stop address latch 116, and a threshold control latch 118 of the track box generator 40, and to a pitch output latch 44 (FIG. 4*b*) and a yaw output latch 46. The latches 110, 112, 44 and 46 are (eight bit) SNC 54100J latches; while, latches 114 and 116 are (six bit) SNC 54174J latches, and latch 118 is a four bit SNC 5475J latch. The CRU clock (CRUCLK) output of CPU 80 is connected by lead 124 to the clock terminals of the latches 110, 112, 114, 116, 118 of FIG. 4*a* and to latches 44 and 46 of FIG. 4*b* and the communications register unit input (CRUIN) terminal of the CPU 80 is connected by lead 126 to a data selector 128. The data selector 128 is connected to the night sight to obtain range information and forward or reverse scan information. The data selector 128 is dispensed with when the processor includes a programmed range formula in which event the INTREQ terminal would be connected directly to the night sight for forward/reverse scan information.

Address bus 130 interconnects the CPU 80, program memory 84, and data memory 86 of the processor 36 to the track box start and stop count latches 110 and 112 (FIG. 4*a*), track box start and stop address latches 114 and 116, and threshold control latch 118 of the track box generator 40; decoder 92; data selector 128 (FIG. 4*b*), and pitch and yaw output latches 44 and 46.

The track box 40 (FIG. 4*a*) has its track box start and stop count latches 110 and 112 connected to comparator 94 and 96, respectively; its track box start and stop address latches 114 and 116 connected to counter 102 and comparator 132, respectively, and threshold control latch 118 connected to digital to analog converter 134. The comparators 94 and 96 have output terminals connected to a multiplex enable circuit 136 and the digital to analog converter 134 has its output terminal connected to comparator 32. The track boxes comparator 132 is, for example, an SNC 5485J; digital to analog converter 134 is, for example, a MC 1508L8; and the multiplex enable circuit 136 is, for example, a SNC5404. The counter 102 has its output terminal connected to the junction of comparator 132, multiplexer 26, and exceedance latch 70 (FIG. 4*b*); while the comparator 132 (FIG. 4*a*) has its output terminal connected to counter 102. Finally the pitch and yaw output latches 44 and 46 (FIG. 4*b*) have their outputs connected, respectively, to digital to analog converters 48 and 50 which provide pitch and yaw position signals to the night sight for transmission to the carrier.

In operation the carrier 12 is launched from launcher 14. Simultaneously with launch, a first motion signal is transmitted to the tracker 22. The first motion signal or forward scan signal is received by the scan counter 98 which begins to count the time of forward scan, and by the data selector 128 for the CPU 80 interrupt request terminal for purposes hereinafter described.

Each of the video channel signals from the night sight beginning with first motion are routed to the tracker amplifiers 62 where they are amplified and fed to the multiplexer 26. Amplification is necessary because of the low level of the night sight signals and the presence of fixed pattern noise in the multiplexer. The multiplexer output signals are fed to the analog to digital converter 64 to the comparator 32.

Shortly after launch, the carrier 12 and its infrared beacon 18 is in the scanners field of view, and the night sight controller 22 outputs an "acquire" signal to the tracker 24. The "acquire" signal activates flip-flop 76 to provide a logic 1 signal to OR gate 68 and interrupt encoder 34. With a logic 1 on OR gate 68 the interrupt encoder interrupts the operation of the processor 36 and locates the carrier's position as to the night sights reticle.

In the meantime, the comparator 32 has been comparing the night sight video signals to a threshold signal. Initially the threshold signal is high because the carrier is close to the night sight and its infrared energy covers the scanners field of view. Thus, when the comparator detects a signal which exceeds its threshold (hereinafter referred to as an exceedance signal) after an "acquire" signal has been received, in all probability, it is the carrier and the tracker is set for tracking the carrier. Therefore, with the occurrence of a threshold exceedance at the comparator output, things happen as follows:

The existing multiplexer address, which is for the number of the night sight channel on which the exceedance signal occurred, is latched into the exceedance address latch 70 and the scan count of scan counter 98 is latched in the exceedance count latch 72.

The amplitude of the exceedance signal is measured and digitized by the analog to digital converter 64 and on completion of the conversion process latched into the amplitude latch 90.

The state of flip-flop 66 is changed to a logic 1 which is applied to the OR gate 68 and interrupt encoder 34 to provide a high priority interrupt request for the processor 36 to stop which it is doing and read the exceedance address latch 70, the exceedance count latch 72, and the amplitude latch 90, and store these values in the processor's data memory 86.

After storing all required data for a particular exceedance the interrupt handler routine clears the interrupt encoder and returns control to the program in progress when the interrupt occurred. As the night sight's scanning mirror crosses boresight, a boresight crossing signal is fed to the boresight latch 42 to latch it. This signal may come before or after carrier acquisition depending on the position of the carrier as to boresight.

At the end of the forward scan the night sight sends a trigger pulse to flip-flop 74 which changes state to a logic 1. The logic 1 signal is applied to the OR gate 68 and interrupt encoder 34 and an interrupt signal is generated which tells the processor 36 to: read the boresight count latch 42, update the track box start and stop latches 110 and 112, and reset the scan counter 98. As the amplitude latch 90, exceedance address and count latches 70 and 72, and boresight count latch 42 are "memory mapped", i.e., they are effectively assigned memory addresses just as if they were processor program or data storage, the hardwire decoder 92 on the address bus 130 decodes these addresses and enables the output of the proper latch under software control. Therefore, accessing the data residing in each latch can be done by a single MOVE instruction and therefor can be done very rapidly.

After signaling the end of forward scan, the night sight signals the beginning of the reverse interlace scan of the mirror and the procedure is repeated for the reverse scan. In addition though at the end of the reverse scan, the processor 36 computes carrier position relative to boresight and outputs this information to the pitch and yaw output latches 44 and 46, and the threshold value to be used in the comparator on the next frame and outputs this information to the threshold control latch 118. Communication with these latches (110, 112, 114, 116, 118, 44, 46, 128) is by way of the processor's communication register unit (CRU) which is a serial input/output structure by means of which up to 4906 bits may be input to an output from the processor either singly or in groups.

The processor's software consists of three interrupt driven routines which perform the functions of acquisition, computation, and exceedance data storage. The acquisition routine assumes that the track will be acquired by a search of the entire night sight field of view with a high threshold.

Referring now to FIG. 5, the flow chart for acquisition of carrier is as follows: The initial step, acquire interrupt 117, is to interrupt the operation of the microprocessor. The next step, disable end of scan interrupt 119, is to prevent the end of scan signal from interrupting the acquisition procedure. The next step, set track box parameters to coincide with full field of view 120, assumes that the track will be acquired by a search of the entire night sight field of view. The next step, set threshold at maximum 122, is based on the assumption that carrier or missile signal will be at a maximum at the point of acquisition and thus, the threshold can be set at a maximum to eliminate as many false signals as possible. The next step, output track box parameters and threshold 125, is to limit the size of the track box frame to reduce the search area and thereby substantially eliminate any false signals within the view. The next step, clear interrupt request flip-flop 127, is to remove the acquisition demand signal. The final step, return 129, is to return the microprocessor to its normal operation.

Referring now to FIG. 6 for a flow chart for carrier position computation, the first step, end of scan interrupt 131, is in response to an end of scan signal. The next step, end of forward scan 133, is a decision step to determine whether the end of scan interrupt signal is the end of a forward scan. If the answer is yes, the next step, store forward scan boresight latch 135, is to enter the count of the boresight latch. The next step, compute track box parameters for reverse scan 137, computes the track box parameters for the reverse scan. The next step, output track box parameters 138, is to set the track box parameters for the reverse scan. The next step, set reverse scan flag 140, is to signal the beginning of the reverse scan. The next step, clear interrupt request flip flop 142 resets the flip flop for the next end of scan. The next step, return 144, returns the microprocessor to normal operation. If the answer in step 133 is no, the next step, store reverse scan boresight latch 146, is to store the count of the boresight latch at the beginning of the reverse scan. The next step, compute track box parameters for forward scan 148, is to identify when in the scan the missile acquisition circuitry is to be activated. The next step, output track box parameters 150, implements step 148. The next step, set forward scan flag 152, is to signal the beginning of the forward scan. The next step, compute exceedance position relative to boresight 154, is to determine the position of the carrier with respect to the boresight to target. The next step, single exceedance 156, in a decision step to determine whether more than one signal step to determine whether more than one signal exists in the track box parameters. If the answer is no, the next step, identify missile exceedance 158, is to identify the carrier position signal and then proceed as though the decision had been that only a single exceedance signal had been received. Next step, compute next frame threshold 160, is to recognize that the carrier acquisition signal, as the carrier moves farther away from the night sight, loses intensity and the next frame threshold must be reduced accordingly. The next step, output next frame threshold 162, is to store the signals for the next frame threshold. The next step, output missile position estimates 164, is to compute the missile position information in pitch and yaw for use in determining yaw and pitch guidance signals. The next step, clear exceedance data storage buffer 166, is to clear the data storage buffer for the next cycle. The next step is the clear interrupt request flip flop step 142. The final step is the return step 144.

Referring now to FIG. 7 which is the flow chart for exceedance data storage. The first step, exceedance interrupt 168, is to disable the normal operation of the computer for storing exceedance data in its memory. The next step, enable end of scan interrupt 170, is to enable the end of scan flip flop to provide the microprocessor with an end of scan signal. The next step, store exceedance count, address, amplitude at address pointed to by exceedance data buffer pointer 172, is to input the computer with information necessary for the computation of the pitch and yaw position information. The next step, is reverse scan flag set 174, is a decision step; if the answer is yes, the next step, set exceedance count sign bit 176, is to provide the appropriate sign for computation. The next step, increment data buffer pointer step 178, is also applicable to a yes decision and is to update the data buffer pointer. The next step, clear interrupt request flip flop 180, is to clear the interrupt request flip-flop prior to returning the microprocessor to its normal operation (return 182 step).

Although, only a single embodiment of this invention has been described herein, it will be apparent to a person skilled in the art that various modifications to the details of construction shown and described may be made without departing from the scope of the invention.

I claim:

1. A system for detecting, tracking and guiding a missile to a target comprising a forward looking infrared receiver including a detector array, a scanner for scanning infrared energy emanating from a field of view across the infrared detector array to produce electrical signals representative of a scene in the field of view, means for viewing the visible image of the scene, said means for viewing including a reticle for boresighting the target in the scene and reticle means for producing a signal indicative of the location of the boresight in the field of view, processing means for processing said electrical signals comprising a multiplexer for multiplexing said electrical signal representative of the infrared energy emanating from the field of view, missile detecting means connected to said multiplexer for determining missile location in the field of view, circuit means connected to said missile detecting means and said reticle means for producing a signal representative of missile location relative to the location of the boresight in the field of view, and means connected to the circuit means for computing guidance correction signals to guide the missile to boresight and eventually to the target.

2. The system of claim 1 wherein the forward looking infrared receiver is responsive to infrared energy having a wavelength in the 3 to 14 micron region.

3. The system of claim 1 wherein the infrared detector array comprises a plurality of detector elements and a corresponding plurality of amplifiers connected to the detector elements for amplifying the electrical output signals, said plurality of detector elements and amplifiers forming a corresponding plurality of video channels.

4. The system of claim 1 wherein the missile detecting means includes a comparator having a variable threshold means for comparing sequentially decreasing threshold voltages with missile location signals to maintain missile location during flight to the target.

5. The system according to claim 4 wherein said circuit means includes a counter which is reset after each scan of the scanner and counts the scan time.

6. The system according to claim 5 where said means for counting reads the count residing in said counter when said threshold voltage is exceeded in said comparator and reads the count when said scanner crosses boresight to give a difference count which is related to the horizontal deviation of the missile from boresight.

7. The system according to claim 1 wherein said missile detecting means selectively limits the signals from said multiplexer to restrict the portion of the field of view over which the missile detecting means searches for the missile.

8. The system according to claim 7 wherein both the size and location of said restricted portion is variable while tracking the missile to the target.

9. In a system for detecting, tracking, and guiding a missile to a target a tracker unit comprising:

(a) a plurality of amplifiers for amplifying and filtering video signals received from detector element channel of a forward looking infrared receiver and sighting means;

(b) a multiplexer connected to the plurality of amplifiers for multiplexing the signals thereof;

(c) a comparator connected to the multiplexer, said comparator having an output connected to a first flip-flop, said comparator for comparing the multiplexed signals to a selected threshold voltage and outputting a signal to activate the first flip-flop when a signal exceeding the threshold is detected, (d) an interrupt encoder, an OR gate, an exceedance address latch and an exceedance count latch having input terminals connected to the output of the first flip-flop;

(f) a second and a third flip-flop having input terminals connected, respectively, to the forward looking infrared receiver and sighting means for receiving, respectively, a signal indicating an end of scan and a signal for directing missile acquisition; and output terminals connected to input terminals of the interrupt encoder and OR gate;

(g) a boresight count latch having an input terminal connected to the forward looking infrared receiver and sighting means for receiving a latch signal indicating when the infrared receiver scanner crosses boresight of the sighting means;

(h) a processor having input terminals connected to the forward looking infrared receiver and sighting means for receiving a signal indicating the beginning of a forward or reverse scan, the OR gate output terminal, the interrupt encoder output terminal, the exceedance address and count latches, and the boresight count latch;

(i) a decoder having output terminals connected to the boresight latch, and exceedance count and address latches;

(j) a clock;

(k) a scan counter having an input terminal connected to the clock and forward looking infrared receiver and sighting means for receiving signals indicating the beginning of forward and reverse scans; said scan counter having an output terminal connected to the exceedance count latch and boresight count latch;

(l) multiple bit pitch and yaw output latches connected to output terminals of the processor;

(m) digital to analog converters connected, respectively, to the pitch and yaw output latches; and (n) a bus interconnecting the processor to the decoder, forward/reverse scan indicating signal, and pitch and yaw output latches;

whereby, first the scan counter is activated by the forward/reverse scan to count scan times and indicating signals, and the processor is enabled; next, the comparator, upon missile acquisition, outputs an exceedance signal to the exceedance address and count latches to latch therein, respectively, the existing multiplexer address and the scan count and to the processor to interrupt it to read the exceedance address, and count latches and store the values in the processor; next, the boresight count latch is latched by the boresight crossing signal; and finally, the processor is interrupted by an end of scan signal to read the boresight count of the boresight latch and compute from the readings the missile's position relative to boresight and output this information to the pitch and yaw output latches.

10. A tracker unit according to claim 9 further including:

(a) an analog to digital converter having input terminals connected to the output terminal of the multiplexer and the output terminal of the comparator;

(b) an amplitude latch having an input terminal connected to the output terminal of the analog to digital converter and an output terminal connected to the processor whereby the analog to digital converter receives each multiplexed signal from the multiplexer and generates, when a corresponding signal exceeds the comparator's threshold, an enabling signal to activate the amplitude latch;

(c) a multibit threshold control latch connected to an output terminal of the processor; and (d) a digital to analog computer connected to the output of the threshold control latch and to an input of the comparator; whereby when the exceedance signal is read and the processor reads out the exceedance address and count latches for computation of the pitch and yaw correction signals the amplitude latch is also read out and stored in the processor for computing, at the end of scan, a new threshold value for the threshold control latch which when commanded by the processor is applied to the digital to analog converter for conversion to an analog signal for use as the comparator's threshold signal for the next scan.

11. A tracker unit according to either of claims 9 or 10 further including: tracker box start and stop count multibit latches and track box start and stop address multibit address latches having input terminals connected to selected output terminals of the processor for receiving updated track box location signals from the processor when computed after receipt of the end of scan signal by the processor, multibit comparators connected, respectively, to the track box start and stop count latches and to the scan counter for comparing the output of the scan counter to the output of track box start and stop count latches and to the scan counter for comparing the output of the scan counter to the output of track box start and stop count latches, a multiplexer enable circuit connected to the output of the comparators said multiplexer enabling circuit connected to the multiplexer for selectively controlling the multiplexer in the pitch direction; and a multibit counter connected to the track box start address latch, a multibit comparator connected to the track box stop address latch counter, and a bus interconnecting the exceedance address latch, comparator, counter and multiplexer for selectively controlling the multiplexer in the yaw direction.

* * * * *